US009234685B2

(12) United States Patent
Koppineedi

(10) Patent No.: US 9,234,685 B2
(45) Date of Patent: Jan. 12, 2016

(54) METHODS AND SYSTEMS TO INCREASE EVAPORATOR CAPACITY

(71) Applicant: THERMO KING CORPRATION, Minneapolis, MN (US)

(72) Inventor: Srinivasa Rao Koppineedi, Bangalore (IN)

(73) Assignee: THERMO KING CORPORATION, Minneapolis, MN (US)

( * ) Notice: Subject to any disclaimer, the term of this patent is extended or adjusted under 35 U.S.C. 154(b) by 201 days.

(21) Appl. No.: 13/956,632

(22) Filed: Aug. 1, 2013

(65) Prior Publication Data

US 2014/0033748 A1 Feb. 6, 2014

Related U.S. Application Data

(60) Provisional application No. 61/678,219, filed on Aug. 1, 2012.

(51) Int. Cl.

| | |
|---|---|
| ***F25B 45/00*** | (2006.01) |
| ***F25B 1/00*** | (2006.01) |
| ***F25B 49/00*** | (2006.01) |
| ***F25B 40/00*** | (2006.01) |
| *F25B 40/02* | (2006.01) |
| *F25B 40/06* | (2006.01) |

(52) U.S. Cl.

CPC ..... *F25B 49/00* (2013.01); *F25B 40/00* (2013.01); *F25B 40/02* (2013.01); *F25B 40/06* (2013.01); *F25B 2700/21175* (2013.01)

(58) Field of Classification Search

CPC ..... F25B 49/00; F25B 40/00; F25B 40/02; F25B 40/06; F25B 2700/21175

USPC ..... 62/119, 190, 223, 225, 216, 498, 513

See application file for complete search history.

(56) References Cited

U.S. PATENT DOCUMENTS

| | | | | |
|---|---|---|---|---|
| 3,748,866 | A * | 7/1973 | Heider et al. | 62/99 |
| 4,017,286 | A | 4/1977 | English et al. | |
| 4,266,405 | A | 5/1981 | Trask | |

(Continued)

OTHER PUBLICATIONS

"Dynamic Modeling and Control of Single and Multi-Evaporator Subcritical Vapor Compression Systems", Rajat Shah, 2003, 256 pages.

(Continued)

*Primary Examiner* — Mohammad M Ali

(74) *Attorney, Agent, or Firm* — Hamre, Schumann, Mueller & Larson, P.C.

(57) ABSTRACT

Embodiments to increase the capacity of the evaporator of a vapor-compression refrigeration system are described. The refrigeration system may be configured to have a first stage suction line heat exchanger and a second stage suction line heat exchanger. The refrigerant exiting the evaporator can be heated by the first heat exchanger. A thermal bulb of an expansion device, such as a thermostatic expansion valve (TXV) can be positioned downstream of the first heat exchanger. The thermal bulb is capable of regulating a variable volume of refrigerant through the expansion device in response to temperature changes. Thus, the superheat refrigerant vapor region in the evaporator can be reduced, thereby increasing the efficiency of the refrigeration system. The refrigerant exiting the evaporator is a liquid/vapor refrigerant mixture. The mixture can be vaporized to a refrigerant vapor in the first heat exchanger.

17 Claims, 6 Drawing Sheets

(56) References Cited

U.S. PATENT DOCUMENTS

| | | | | |
|---|---|---|---|---|
| 4,438,881 | A * | 3/1984 | Pendergrass | 237/2 B |
| 4,918,942 | A | 4/1990 | Jaster | |
| 4,959,972 | A * | 10/1990 | Lowes | F25B 40/00 62/200 |
| 5,207,072 | A | 5/1993 | Arno et al. | |
| 5,341,649 | A * | 8/1994 | Nevitt et al. | 62/126 |
| 5,431,026 | A | 7/1995 | Jaster | |
| 6,405,550 | B1 * | 6/2002 | Reason et al. | 62/217 |
| 6,457,325 | B1 * | 10/2002 | Vetter | 62/473 |
| 6,568,198 | B1 * | 5/2003 | Tadano et al. | F25B 1/10 62/217 |
| 6,581,398 | B2 | 6/2003 | Wightman | |
| 6,581,408 | B1 * | 6/2003 | Tadano | F25B 1/10 62/199 |
| 6,606,867 | B1 * | 8/2003 | Sienel | 62/113 |
| 7,377,126 | B2 | 5/2008 | Gorbounov et al. | |
| 7,908,881 | B2 | 3/2011 | Kopko | |
| 2007/0095087 | A1 * | 5/2007 | Wilson et al. | 62/259.2 |
| 2009/0272128 | A1 * | 11/2009 | Ali | 62/56 |
| 2009/0282858 | A1 * | 11/2009 | Demetri | B01D 45/12 62/401 |
| 2010/0083679 | A1 * | 4/2010 | Kolstad et al. | 62/117 |
| 2010/0089083 | A1 * | 4/2010 | Awwad et al. | 62/216 |
| 2010/0107661 | A1 * | 5/2010 | Awwad et al. | 62/80 |
| 2010/0139313 | A1 * | 6/2010 | Taras | 62/498 |
| 2011/0138886 | A1 * | 6/2011 | McDonald et al. | 73/46 |

OTHER PUBLICATIONS

"Regulation of the Liquid-Mass-Fraction of the Refrigerant Exiting an Evaporator", J.R. Solberg and N.R. Miller, Jan. 2000, 26 pages.

* cited by examiner

METHODS AND SYSTEMS TO INCREASE EVAPORATOR CAPACITY

FIELD OF TECHNOLOGY

The embodiments disclosed herein relate generally to an evaporator of a refrigeration system. More particularly, the embodiments relate to increasing the capacity of the evaporator of a transport refrigeration system (TRS).

BACKGROUND

An evaporator of, for example, a vapor-compression transport refrigeration system is generally positioned in a space to be cooled and allows heat exchange between refrigerant in the evaporator and air in the space during a cooling cycle. Liquid refrigerant coming out of a condenser usually goes through an expansion device, such as a thermostatic expansion valve (TXV), to turn into a vapor/liquid refrigerant mixture entering an inlet of the evaporator. The TXV can have a remote thermal control bulb positioned at the exit of the evaporator that can sense a temperature change of the superheat refrigerant vapor at the exit of the evaporator and control the volume of refrigerant entering the evaporator through the TXV accordingly. If the temperature of the superheat refrigerant vapor measured at the exit of the evaporator increases, the remote thermal control bulb can cause the TXV to open up so that more refrigerant may be permitted through the TXV. If the temperature of the superheat refrigerant vapor measured at the exit of the evaporator decreases, the remote thermal control bulb can cause the TXV to close down so that less refrigerant may be permitted through the TXV. The remote thermal control bulb can be configured so that the state of the refrigerant at a position where the bulb is attached is in a vapor state.

SUMMARY

Embodiments that can increase the capacity of the evaporator of a refrigeration system are described. In particular, systems and methods for providing a thermal control device at a heat exchanging device are provided to reduce the presence of superheat refrigerant in an evaporator.

In some embodiments, a refrigeration system is provided to include an evaporator having an inlet and an exit, a thermal control device, and an expansion device that is positioned upstream of the inlet. The expansion device may be controlled by the thermal control device to provide a variable volume of refrigerant into the evaporator. The refrigeration system may also include a heat exchanging device that has a first portion positioned downstream of the exit of the evaporator along a suction line of the refrigeration system, and a second portion positioned downstream of the first heat exchanging portion along the suction line of the refrigeration system. In some embodiments, the thermal control device is positioned between the first portion and the second portion, and is configured to sense a temperature change of a refrigerant and regulate the variable volume of refrigerant in response to the temperature change.

In some embodiments, the first portion may be configured to receive liquid refrigerant coming out of a condenser and refrigerant coming out of the evaporator, and allow heat transfer between the liquid refrigerant coming out of the condenser and the refrigerant coming out of the evaporator.

In some embodiments, the first portion may have a liquid refrigerant line and a refrigerant suction line, and the liquid refrigerant line of the first heat exchanging portion receives the liquid refrigerant from the second portion.

In another embodiment, a method of controlling an amount of refrigerant entering an evaporator of a refrigeration system during a cooling cycle is provided. The method may include directing a refrigerant flow to an expansion device and directing the expanded refrigerant flow through an evaporator.

In some embodiments, the method may include directing the refrigerant flow exiting the evaporator into a first stage heat exchanging portion and directing the refrigerant flow exiting the first stage heat exchanging portion into a second stage heat exchanging portion through a connecting suction line. In some embodiments, the method may include controlling the volume of the refrigerant through the expansion device by positing a thermal control bulb on the connecting suction line.

In some embodiments, the refrigerant flow at the connecting suction line may be configured to be in a vapor state, and the refrigerant flow at an exit of the evaporator may be configured to be in a liquid/vapor mixture. In some embodiments, the refrigerant flow at the exit of the evaporator may be configured to be in a set liquid/vapor ratio.

In some embodiments, the method may include directing the refrigerant flow exiting the evaporator into a suction line heat exchanger and controlling the volume of the refrigerant through the expansion device by a remote thermal control bulb positioned between the first heat exchanging portion and the second heat exchanging portion of the heat exchanging device.

In some embodiments, the method may include positioning a remote thermal control bulb in a position that is about half of a length of the suction line heat exchanger. In some embodiments, the method may include controlling the volume of the refrigerant through the expansion device by changing the position of the remote thermal control bulb on the heat exchanger so that the refrigerant exiting the evaporator is a liquid/vapor mixture.

BRIEF DESCRIPTION OF THE DRAWINGS

Referring now to the drawings in which like reference numbers represent corresponding parts throughout.

DETAILED DESCRIPTION

In a transport refrigeration system, such as a vapor-compression type transport refrigeration system, liquid refrigerant may enter into an evaporator through a TXV. The TXV controls the amount of refrigerant entering into the evaporator based on temperature changes of a superheat refrigerant exiting the evaporator. The superheat refrigerant vapor may be present in the evaporator. Because the superheat vapor has a reduced heat transfer coefficient, the presence of superheat refrigerant in the evaporator may reduce the efficiency of the evaporator.

In the following description of the illustrated embodiments, embodiments to increase the capacity of an evaporator of a transport refrigeration system are described.

In one embodiment, a transport refrigeration system with a two stage suction line heat exchanging device that includes a first and a second heat exchanging portion is provided. A remote refrigerant control bulb of a TXV may be positioned between a first stage suction line heat exchanging portion and a second stage suction line heat exchanging portion.

In another embodiment, a transport refrigeration system with a single stage suction line heat exchanger is provided. A remote refrigerant control bulb of a TXV may be positioned on a position of the single stage suction line heat exchanger that divides the heat exchanger into two portions.

The methods and systems described herein may reduce a superheat vapor zone in the evaporator, and thereby reduce the presence of the super heat refrigerant in the evaporator. Thus, the efficiency of the evaporator may be increased.

References are made to the accompanying drawings that form a part hereof, and in which is shown by way of illustration of the embodiments in which the apparatus may be practiced. It is understood that the terms "liquid refrigerant" and "refrigerant vapor" are not exclusive: liquid refrigerant may contain some refrigerant vapor and refrigerant vapor may contain some liquid refrigerant. The terms "upstream" and "downstream" are used to refer to the relative position of a device in reference to another device along the direction of a refrigerant flow during a cooling cycle of the refrigeration system. Generally if device A is positioned upstream of device B, then the refrigerant flow generally reaches the position of device A first before reaching the position of device B during a cooling cycle. Conversely, if device A is positioned downstream of device B, then the refrigerant flow generally reaches device B before reaching the position of device A during a cooling cycle. It is to be understood that the terms used herein are for the purpose of describing the figures and embodiments and should not be regarded as limiting the scope of the present invention.

Figure 1:
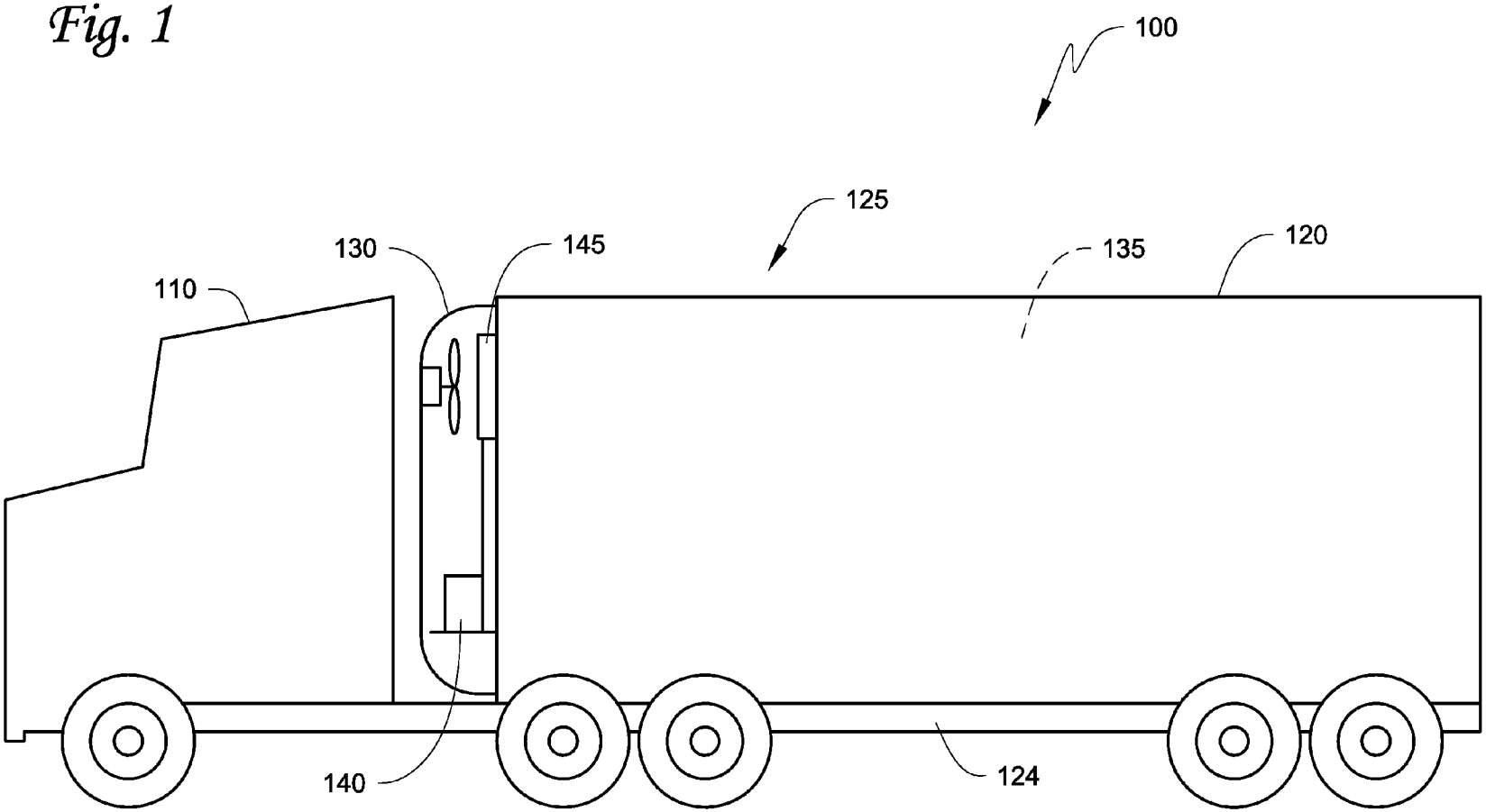
FIG. 1 illustrates a side schematic view of a transport temperature controlled trailer unit with a transport refrigeration system.

Embodiments as described herein can be generally used in a TRS such as, for example, a temperature controlled semi-trailer truck 100 as illustrated in FIG. 1. The semi-trailer truck 100 has a tractor unit 110 that is configured to tow a temperature controlled trailer unit 120 having a TRS 125. The trailer unit 120 is installed on a frame 124. The TRS 125 includes a transport refrigeration unit (TRU) 130 that is installed on a side wall of the trailer unit 120. The TRS 125 is configured to transfer heat between an internal space 135 and the outside environment to cool the internal space 135. The TRU 130 has a compressor 140 and an evaporator 145.

It will be appreciated that the embodiments described herein are not limited to trucks and trailer units. The embodiments described herein may be used in any other suitable temperature controlled apparatuses, such as a container or any other suitable air condition systems. Also, the refrigeration system may be a vapor-compressor type refrigeration system, or any other suitable refrigeration systems that use a refrigerant and an evaporator.

Figure 2:
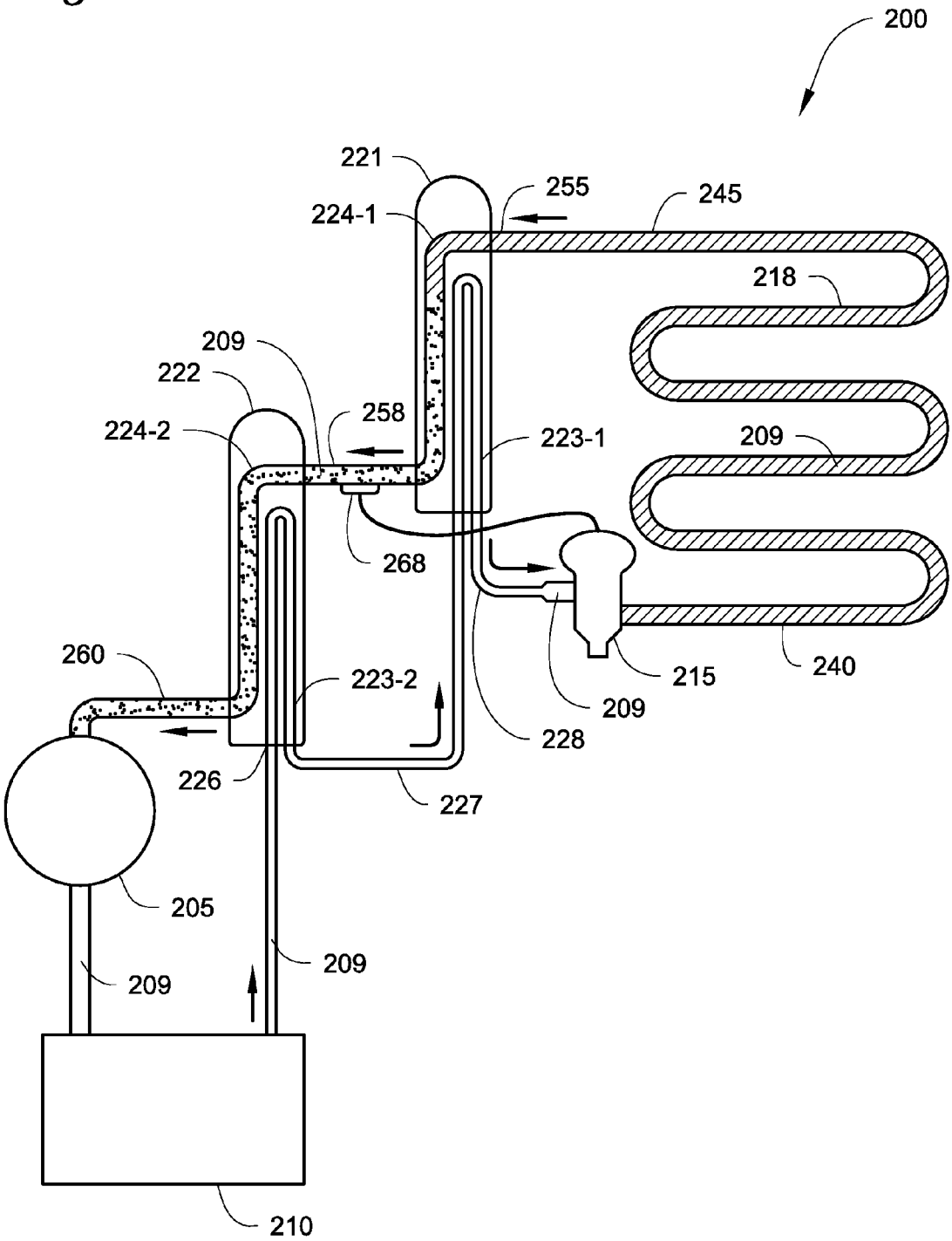
FIG. 2 illustrates a schematic view of an embodiment of a refrigeration system with an increased evaporator capacity that includes a two-stage heat exchanging device that has a first and second suction line heat exchanging portions during a cooling cycle.

Referring now to FIG. 2, a refrigeration system 200 having an increased evaporator capacity is described. The refrigeration system 200 includes a compressor 205, a condenser 210, a TXV 215 and an evaporator 218. The refrigeration system 200 also includes two-stage heat exchanging device that has a first stage suction line heat exchanging portion (SLHE-1) 221 and a second stage suction line heat exchanging portion (SLHE-2) 222.

During a cooling cycle, the direction of the refrigerant flow in the system 200 is shown by the arrows in FIG. 2. The compressor 205 is configured to compress a refrigerant 209. The refrigerant 209 in the compressor 205 is often in a vapor state. After compression by the compressor 205, the refrigerant 209 is configured to enter the condenser 210 to release heat to the environment. After the condenser 210, the refrigerant 209 is often in a liquid state. The refrigerant 209 coming out of the condenser 210 first enters the liquid line inlet 226 of the SLHE-2 222, and then flows to the SLHE-1 221, which is positioned downstream of the SLHE-2 222 through a connecting liquid line 227. The refrigerant 209 then comes out of the SLHE-1 221 via a liquid line outlet 228 and then enters the TXV 215.

After the refrigerant 209 exits the TXV 215, a portion of the refrigerant 209 is typically expended to the vapor state. Therefore, the refrigerant 209 becomes a liquid/vapor mixture entering the inlet 240 of the evaporator 218. The refrigerant 209 can then absorb heat in the evaporator 218 from the environment, and the liquid portion of the liquid/vapor mixture of the refrigerant 209 can be vaporized by the heat absorbed.

The refrigerant 209 exits the evaporator 218 at an exit 245. The refrigerant 209 coming out of the evaporator exit 245 enters the SLHE-1 221 through a SLHE-1 suction line inlet 255. The refrigerant 209 then flows to SLHE-2 222 through a connecting suction line 258. The refrigerant 209 then flows out of the SLHE-2 222 through a suction line outlet 260. The refrigerant 209 then flows back to the compressor 205.

SLHE-1 221 and SLHE-2 222 can be configured to include a liquid line (223-1 and 223-2 respectively) and a suction line (224-1 and 224-2 respectively) inside. In SLHE-1 221, the liquid line 223-1 connects the connecting liquid line 227 and the liquid line outlet 228. The suction line 224-1 connects the suction line inlet 255 and the connecting suction line 258. In SLHE-2 222, the liquid line 223-2 connects the liquid inlet 226 to the connecting liquid line 227, and the suction line 224-2 connects the connecting suction line 258 to the suction line outlet 260. The liquid lines generally carry the refrigerant 209 in the liquid state, and the suction lines generally carry the refrigerant 209 in the vapor state. In both SLHE-1 221 and SLHE-2 222, the liquid lines 223-1 and 223-2 may be positioned close to the suction line 224-1 and 224-2 respectively inside the heat exchangers SLHE-1 221 and SLHE-2 222. Heat exchange between the refrigerant 209 in the liquid lines 223-1, 223-2 and the suction lines 224-1, 224-2 can happen in both SLHE-1 221 and SLHE-2 222.

As shown in FIG. 2, a remote thermal control bulb 268 of the TXV 215 is positioned on the connecting suction line 258 between SLHE-1 221 and SLHE-2 222. The remote thermal control bulb 268 is configured to control the amount of liquid refrigerant 209 entering the evaporator 218 through the TXV 215. Thus, the refrigerant 209 in the connecting suction line 258 can be maintained in the vapor state by the bulb 268. Further, the SLHE-1 221 is configured to transfer heat to the refrigerant 209 entering the suction line inlet 255. Accordingly, the refrigeration system 200 can be configured so that the refrigerant 209 entering the suction line inlet 255 is still a liquid/vapor mixture state. The refrigerant 209 in the liquid/ vapor mixture state can then further absorb heat in SLHE-1 221 so that the refrigerant 209 in the connecting suction line 258 is in the vapor state.

In operation, as shown in FIG. 2, the refrigerant 209 that is still in the vapor/liquid mixture state exits the evaporator 218 and then enters the SLHE-1 221. The SLHE-1 221 is configured such that the refrigerant 209 in the suction line 224-1 exchanges heat with the refrigerant 209 in the liquid line 223-1. The refrigerant 209 can be vaporized from the vapor/liquid mixture state to the superheat vapor state in SLHE-1 221 and then exits the SLHE-1 221 at the connecting suction line 258. The refrigerant 209 in the vapor state then further enters the SLHE-2 222. Accordingly, the presence of the refrigerant 209 in the superheat vapor state in the evaporator 218 can be reduced or eliminated in the evaporator 218 of the refrigeration system 200 as shown in FIG. 2. The SLHE-2 222 is configured such that heat exchange occurs between the refrigerant 209 in the liquid state in the liquid line 223-2 and the refrigerant 209 in the vapor state in the suction line 224-2 before the refrigerant 209 in the vapor state exits the SLHE-2 222 at the suction line outlet 260 and enters the compressor 205.

The remote thermal control bulb 268 of the TXV 215 is configured to sense a temperature change of the refrigerant 209 in the superheat vapor state at the connecting suction line 258. If the temperature increases, the remote thermal control bulb 268 is configured to cause the TXV 215 to open up, thereby allowing more refrigerant 209 to enter the evaporator 218. If the temperature decreases, the remote thermal control bulb 268 is configured to cause the TXV 215 to close down thereby decreasing the amount of refrigerant 209 entering the evaporator 218. By positioning the thermal control bulb 268 between the SLHE-1 221 and the SLHE-2 222, the amount of the refrigerant 209 into the evaporator 218 can be configured so that the refrigerant 209 transforms from the liquid/vapor state to the superheat vapor state between the SLHE-1 221 and the SLHE-2 222. Thus, the refrigerant 209 in the superheat vapor state in the evaporator 218 can be reduced.

Similar to a conventional refrigeration system, the TXV 215 of the refrigeration system 200 as shown in FIG. 2 can be a conventional TXV for a refrigeration system. Generally, for a refrigeration system of a similar capacity, the SLHE-1 221 and/or the SLHE-2 222 can be configured to have a smaller size or capacity than that of a conventional heat exchanger. The combined size or capacity of the SLHE-1 221 and the SLHE-2 222 can be configured to be similar to that of a conventional heat exchanger. It is to be understood that the size and/or capacity of the SLHE-1 221 and SLHE-2 222 may be configured differently from each other. It is also to be noted that the size and/or capacity of the SLHE-1 221 and/or SLHE-2 222 can be optimized by testing. One method of optimizing the size of the SLHE-1 221 and/or SLHE-2 222 is discussed below.

Figure 3:
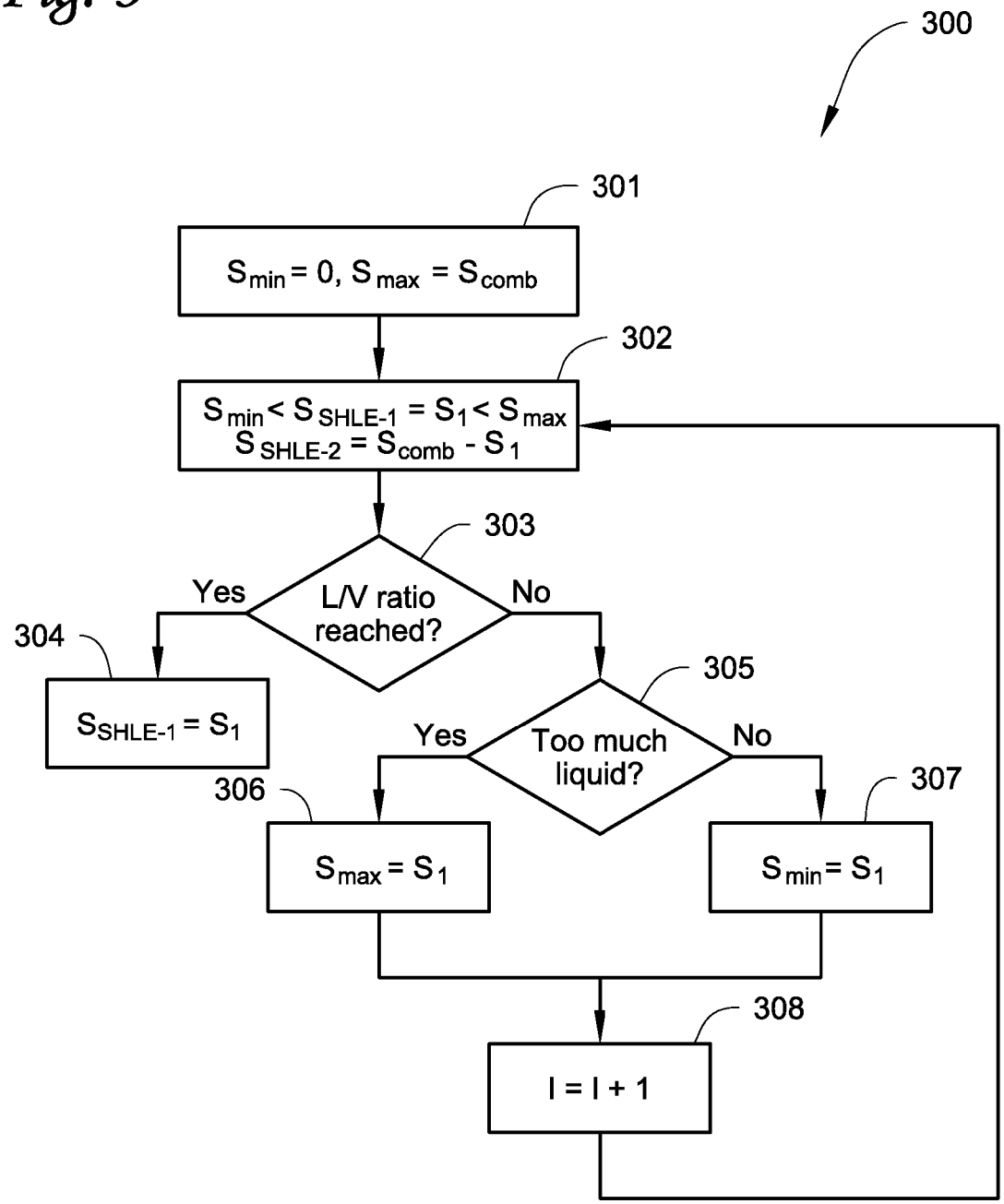
FIG. 3 illustrates a method to determine the size of the first and/or second heat exchanging portions in the refrigeration system shown in FIG. 2, according to one embodiment.

Referring to FIG. 3, a method 300 to optimize the size (capacities) of SLHE-1 221 and/or SLHE-2 222 in the embodiment as shown in FIG. 2 is illustrated. The SLHE-1 221 and/SLHE-2 222 can be configured to have a combined heat exchanging size $S_{comb}$. The combined heat exchanging size $S_{comb}$ can be determined according to parameters such as the cooling capacity of the refrigeration system 300, and/or a pressure drop in the suction line. At 301, initial parameters $S_{min}$ and $S_{max}$ are set as 0 and $S_{comb}$ respectively. At 302, a size of the SLHE-1 221 ($S_I$) is set to be between $S_{min}$ and $S_{max}$. "I" in $S_I$ is a changing number set by the method 300, and can be set initially as 1. The size of SLHE-2 222 is configured so that the combined capacity of SLHE-1 221 and SLHE-2 222 remains at $S_{comb}$. At 303, a liquid/vapor refrigerant ratio (L/V ratio) of the refrigerant 209 at the exit 245 of the evaporator 218 of the refrigeration system 200 is measured and compared to a set L/V ratio. The term L/V ratio is a ratio between a volume of liquid refrigerant and a volume of the refrigerant vapor in the liquid/vapor refrigerant 209. If the L/V ratio of the refrigerant 209 reaches the set L/V, then the size of the SLHE-1 221 is set to be equal to $S_I$, as shown at 304. If the set L/V ratio is not reached, the method 300 proceeds to 305.

At 305, the method 300 determines whether the refrigerant 209 has a higher liquid portion in comparison to the set L/V ratio. If the refrigerant 209 has a higher L/V value than the set L/V value (which means the liquid portion of the refrigerant 209 is more than the set L/V value), the method 300 proceeds to 306, otherwise the method 300 proceeds to 307. At 306, $S_{max}$ is set to be $S_I$. At 307, $S_{min}$ is set to be $S_I$. After both 306 and 307, the parameter I is set to be I+1 at 308. The method 300 then returns to 302.

The set L/V ratio at the exit 245 of the evaporator 218 may be associated with the states of the refrigerant 209 at the connection suction line 258 that is downstream of SLHE-1 221. Generally, the set L/V ratio may be configured so that the state of the refrigerant 209 at the connection suction line 258 is at a super heat state. In some embodiments, the set L/V ratio may be configured so that the temperature of the refrigerant 209 at the connection suction line 258 is at a super heat state of a specific temperature such as, for example, about 5 degrees Celsius.

Figure 4:
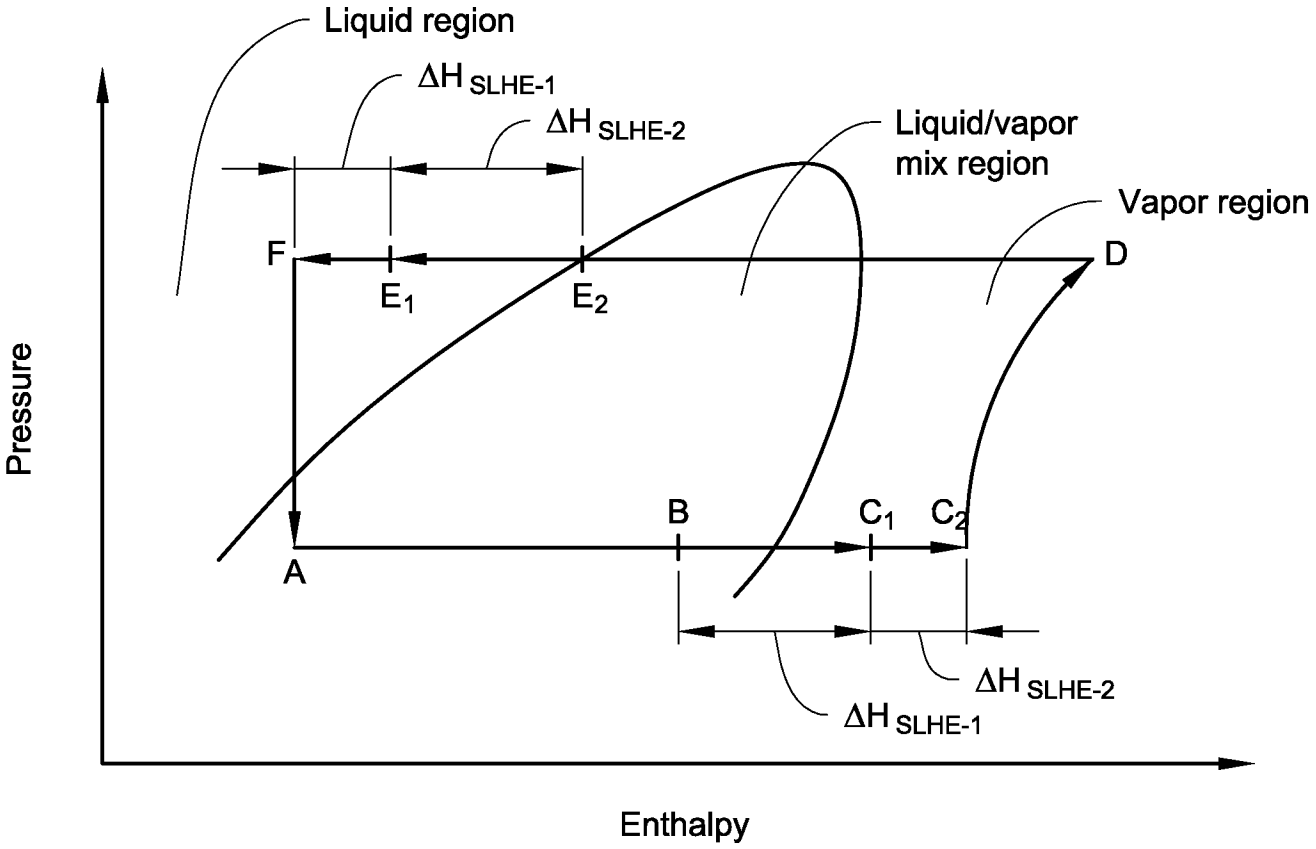
FIG. 4 illustrates a Pressure/Enthalpy chart (P-H chart) of the refrigerant in the refrigeration system shown in FIG. 2, according to one embodiment.

FIG. 4 shows pressure/enthalpy chart (P-H chart) of the refrigerant in an embodiment of the refrigeration system with a two stage heat exchanger such as the system 200 as shown in FIG. 2.

From point $C_2$ to point D, the refrigerant vapor is compressed in the compressor, and the pressure and the enthalpy of the refrigerant is increased. From point D to point $E_2$, the compressed refrigerant vapor then enters into the condenser and releases heat to the environment to become a liquid refrigerant. In this step, the pressure remains the same, but the enthalpy reduces because of heat loss. After exiting the condenser, the liquid refrigerant flows into the SLHE-2 and SLHE-1 as shown in FIG. 2 respectively. From points $E_2$ to F, the liquid refrigerant transfers heat to the refrigerant in the suction line coming out of the evaporator in the SLHE-2 and SLHE-1, which further reduces the enthalpy of the liquid refrigerant without changing the pressure. From point F to point A the liquid refrigerant then goes through a TXV to become a liquid/vapor refrigerant mixture. In this step, the pressure drops but the enthalpy remains the same. From point A to point B, in the evaporator, the refrigerant liquid vapor mixture absorbs heat from the environment. In this step, the pressure remains the same while the enthalpy of the refrigerant increases. From point B to point $C_2$ the refrigerant exiting the evaporator enters the SLHE-1 and SLHE-2 to absorb heat from the liquid refrigerant in the liquid line as discussed above. This can further increase the enthalpy of the refrigerant without changing the pressure, as shown by FIG. 4.

In the refrigeration system with an increased evaporator capacity, such as the system 200 as shown in FIG. 2, the amount of superheat refrigerant vapor in the evaporator can be reduced or eliminated. As shown by point B in FIG. 4, which represents the state of the refrigerant when the refrigerant exits the evaporator, the refrigerant exiting the evaporator can be in a liquid/vapor mixture state. From points B to $C_1$, the mixture exiting the evaporator then enters the SLHE-1 to absorb heat from the liquid refrigerant in the liquid line and become superheat refrigerant vapor. From point $C_1$ to point $C_2$, the refrigerant vapor further absorbs heat in SLHE-2. On the other hand, from points $E_2$ to $E_1$, the liquid refrigerant exiting the condenser enters and exits the SLHE-2 first, and then from points from $E_1$ to F the liquid refrigerant enters and exits the SLHE-1. The remote thermal control bulb can be configured to sense the temperature changes of the superheat refrigerant vapor at a position corresponding to the point $C_1$ in FIG. 4, so that the refrigeration cycle as shown in the P-H chart of FIG. 4 may be maintained.

The evaporator of the refrigerant system 200 as shown in FIG. 2 can have an increased load or efficiency compared to a conventional system. Suction pressure may also increase in the refrigeration system 200 as shown in FIG. 2 compared to a conventional system.

As discussed above, the size and capacity of the SLHE-1 and the SLHE-2 may be optimized so that point $C_1$ as shown in FIG. 4 may be maintained in the superheat vapor region, while point B may be maintained in the liquid/vapor refrigerant mixture region. In some embodiments, the SLHE-1 and the SLHE-2 may be configured so that $\Delta H_{SLHE\text{-}1}$ may be about nine times of $\Delta H_{SLHE\text{-}2}$. In some embodiments, the temperature difference between the temperature of the entering liquid refrigerant and the temperature of the exiting liquid refrigerant in the SLHE-1 may be about 3° C. to about 20° C. In some embodiments, the size and capacity of the SLHE-1 and the SLHE-2 may be about the same.

Figure 5:
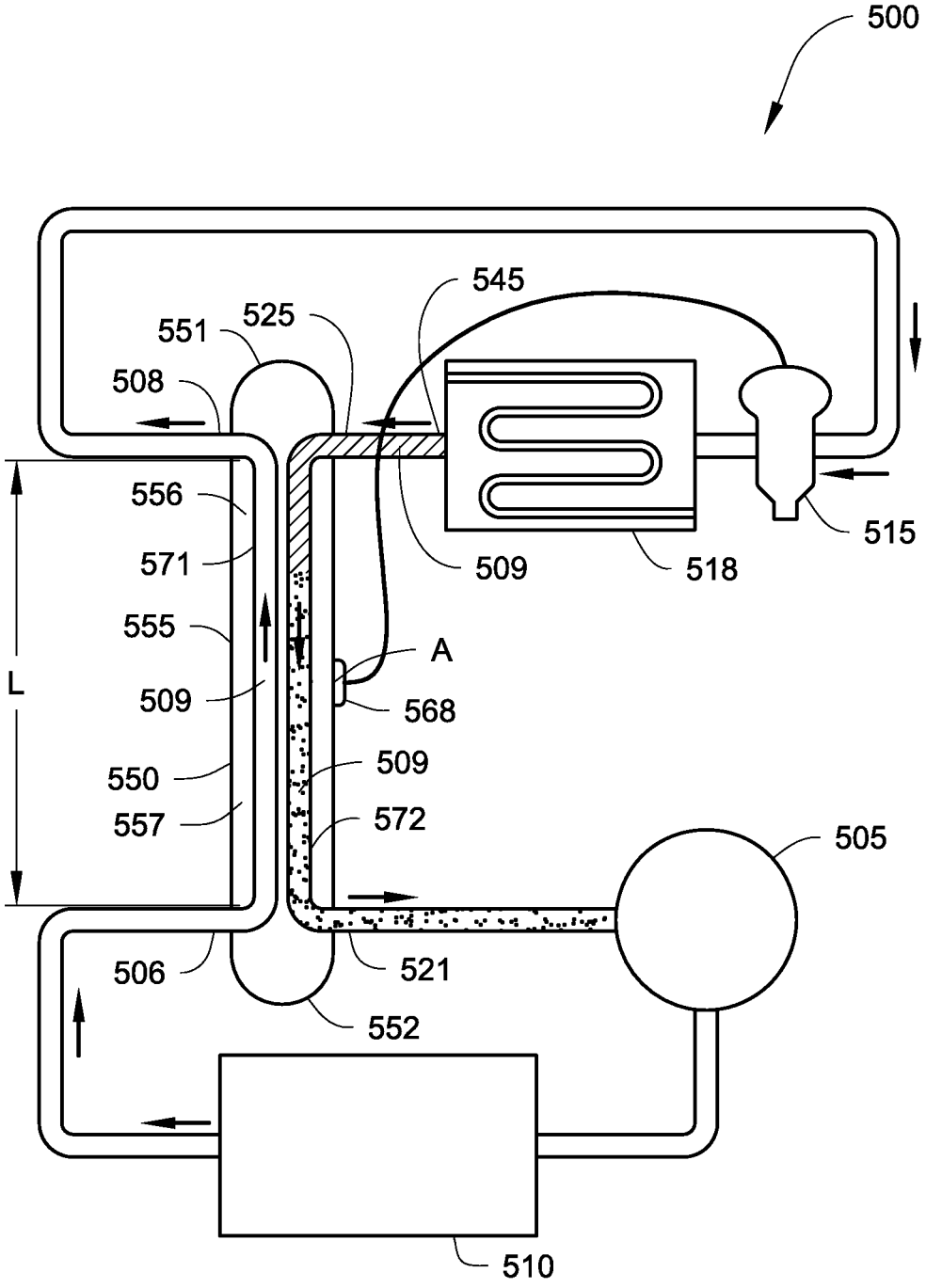
FIG. 5 illustrates a schematic view of another embodiment of a refrigeration system with an increased evaporator capacity during a cooling cycle.

Referring now to FIG. 5, another embodiment of a refrigeration system 500 with an increased evaporator capacity is shown. The refrigeration system 500 generally includes a compressor 505, a condenser 510, a TXV 515, and an evaporator 518.

The refrigeration system 500 includes a single stage suction line heat exchanger 550 that has a first end 551 and a second end 552. In this embodiment, the heat exchanger 550 is tubular. In other embodiments, the heat exchanger 550 can be, for example, a shell and tube heat exchanger, a brazed plate heat exchanger, a co-axial type heat exchanger, a shell and coil type heat exchanger, or any other type of heat exchanger.

The heat exchanger 550 also includes a shell 555. The heat exchanger 550 has a liquid line inlet 506, a liquid line outlet 508, a suction line inlet 525 and a suction line outlet 521. Inside the heat exchanger 550, a suction line portion 572 of the refrigeration system 500 connects the suction line inlet 525 and outlet 521. Also, inside the heat exchanger 550, a liquid line portion 571 of the refrigeration system 500 connects the liquid line inlet 506 and outlet 508. The single stage suction line heat exchanger 550 has a heat exchanging region of a length L that is defined by a region of the liquid line portion 571 and the suction line portion 572 that are positioned side by side.

In this embodiment, the flow direction of a refrigerant 509 is shown by arrows in FIG. 5. The direction of the refrigerant 509 in the suction line 572 can be configured to be in an opposite direction to the direction of the refrigerant 509 in the liquid line 571 inside the heat exchanger 550. Thus, heat exchange can occur between the liquid line portion 571 and the suction line portion 572 inside the heat exchanger 550.

The shell 555 of the heat exchanger 550 is configured to be able to conduct heat. A remote thermal control bulb 568 of the TXV 515 is positioned on the shell 555 between the first end 551 and the second end 552 at a position A. The position of the remote thermal control bulb 568 divides the heat exchanger 550 into two portions: a first portion 556 and a second portion 557. The first portion 556 is generally between the first end 551 and the position A, and the second portion 557 is generally between the second end 552 and the position A.

In operation, the refrigeration system 500 is configured so that the refrigerant 509 exiting the exit 545 of the evaporator 518 and entering the suction line inlet 525 is generally in a vapor/liquid mixture state. In the heat exchanger 550, the refrigerant 509 that is generally in the liquid/vapor mixture state can be further vaporized by exchanging heat with the refrigerant 509 in the liquid line portion 571 and turn into the refrigerant 509 in the vapor state. The remote thermal control bulb 568 of the TXV 515 is configured to sense a temperature change of the refrigerant 509 in the position A between the first portion 556 and the second portion 557. The position A of the bulb 568 can be optimized by testing. One method of optimizing the position A of the bulb 568 by testing is discussed below. By positioning the remote thermal control bulb 568 between the first portion 556 and the second portion 557, the refrigerant 509 can be configured to become the superheat vapor in the heat exchanger 550. For example, the position of the remote thermal control bulb 568 can be configured so that the refrigerant 509 may be mostly in a vapor/liquid mixture state in the first portion 556; while the refrigerant 509 may be mostly in a superheat vapor state in the second portion 557. Thus the superheat refrigerant 509 in the evaporator 518 can be reduced or eliminated.

Figure 6:
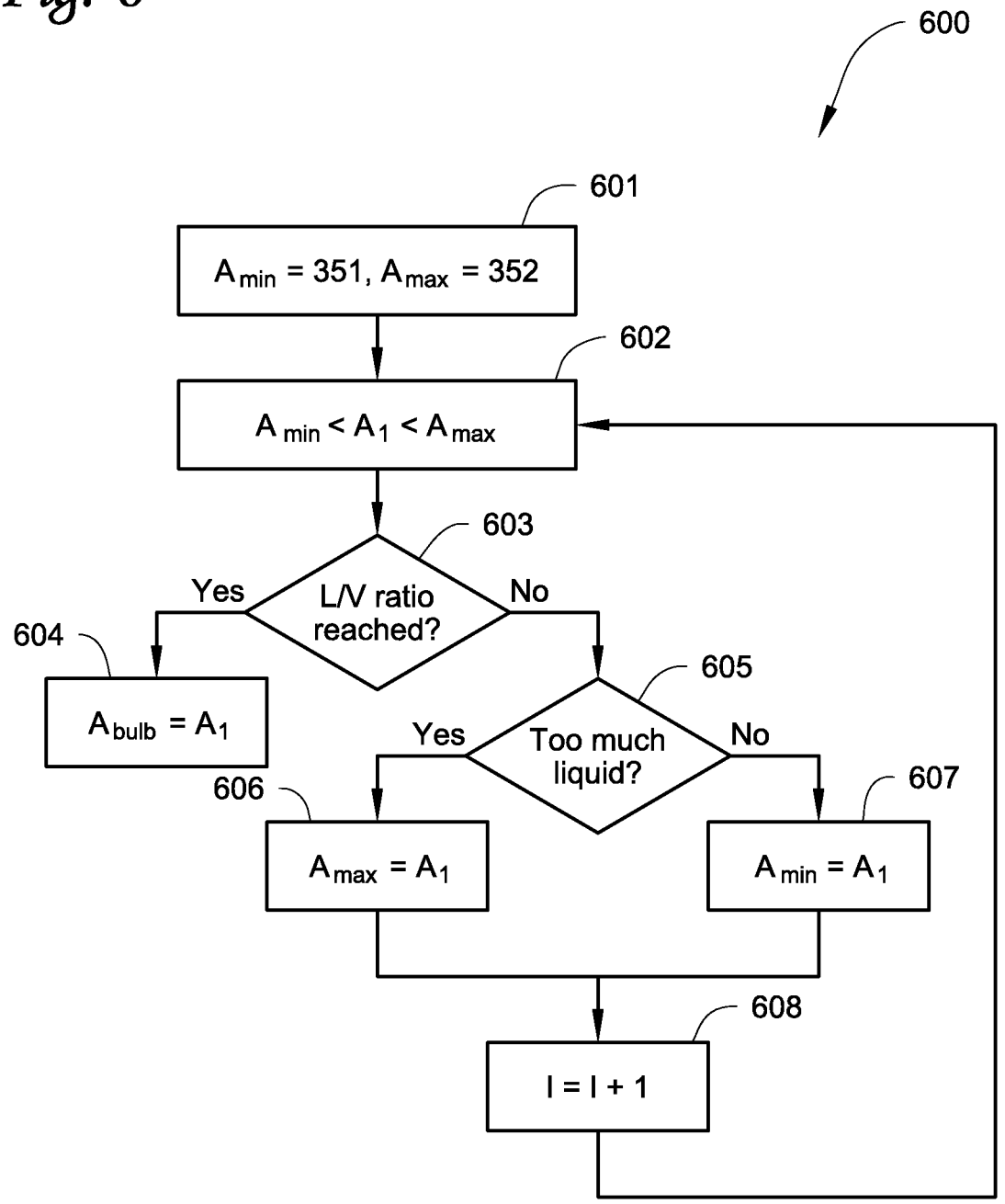
FIG. 6 illustrates a method to determine the position of a remote thermal control bulb of a TXV on a heat exchanger of the refrigeration system as shown in FIG. 5, according to one embodiment.

Referring now to FIG. 6, a method 600 to optimize the position $A_{bulb}$ of the bulb 568 as shown in FIG. 5 is illustrated. At 601, initial parameters $A_{min}$ and $A_{max}$ are set to be at the first end 551 and the second end 552 respectively. At 602, a position parameter $A_I$ is set to be between $A_{min}$ and $A_{max}$. "I" of $A_I$ is a changing number that is set by the method 600, and initially can be set as 1. At 603, a liquid/vapor refrigerant ratio (L/V ratio) of the refrigerant 609 at the exit 518 of the refrigeration system 500 is measured and compared to a set L/V ratio. If the set L/V ratio is reached, then the position $A_{bulb}$ is set to be equal to $A_I$, as shown at 604. If the set L/V ratio is not reached, the method 600 proceeds to 605. At 605, the method 600 determines whether the refrigerant 609 reaches the set L/V ratio. If the refrigerant 609 has higher liquid portion (which means the L/V ration of the refrigerant 609 is higher than the set L/V ratio), the method 600 proceeds to 606. Otherwise the method 600 proceeds to 607. At 606, $A_{max}$ is set to be $A_I$. At 607, $A_{min}$ is set to be $A_I$. After both 606 and 607, the parameter I is set to be I+1 at 608. The method 600 then returns to 602.

The position A of the remote thermal control bulb 568 may be similarly optimized using a similar P-H chart as shown in FIG. 4. In some embodiments, the position A of the remote thermal control bulb 568 may be configured so that the refrigerant at position A is in super heat region in the P-H chart, while the refrigerant at the exit 545 of the evaporator 518 is maintained in the liquid/vapor refrigerant mixture region in the P-H chart. In some embodiments, the bulb 568 may be positioned so that the enthalpy change of the refrigerant in the suction portion inside the heat exchanger 550 from the suction line inlet 525 to position A (i.e. the first portion 556) may be nine times of the enthalpy change from the position A to the suction line outlet 521 (i.e. the second portion 557). In some embodiments, the temperature difference between the temperature of the liquid refrigerant entering position A and the temperature of the liquid refrigerant exiting at the liquid line exit 608 may be about 3° C. to about 35° C. In some embodiments, the temperature difference between the temperature of the entering liquid refrigerant at liquid line inlet 606 and the temperature of the liquid refrigerant at position A may be at least about 5° C. In some embodiments, the position A of the bulb 568 may be at about the middle of the heat exchanger 550.

EXAMPLE

A comparative example is provided.

In configuration I, the bulb of the TXV was positioned at the exit of the evaporator of a refrigeration system with a 31-inch suction line heat exchanger, which is similar to the configuration as shown in FIG. 2. In configuration II, the bulb of the TXV was positioned at the middle of a 31-inch suction line heat exchanger shell, which is similar to the configuration as shown in FIG. 5. In this configuration, SLHE-1 and SLHE-2 may be also considered as two consecutive half sections of the 31-inch suction line heat exchanger. The refrigerant flow rate, suction pressure and TXV inlet temperature were measured for both configuration I and configuration II. The results showed that configuration II has a higher refrigerant flow rate, a higher suction pressure and a lower TXV inlet temperature. These results indicate that the configuration II has higher evaporator efficiency.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What is claimed is:

1. A refrigeration circuit comprising:

an evaporator;

a condenser;

an expansion device configured to provide a variable volume of refrigerant into the evaporator;

a suction line heat exchanger including a liquid line inlet and a suction line inlet, the liquid line inlet configured to receive refrigerant from the condenser and the suction line inlet configured to receive refrigerant from the evaporator, the suction line configured to facilitate heat exchange between refrigerant flowing out of the condenser and refrigerant flowing out of the evaporator;

a thermal control device configured to measure a temperature of the refrigerant at a measurement location downstream of the suction line inlet of the suction line heat exchanger; and a second suction line heat exchanger positioned downstream of the suction line heat exchanger;

wherein the measurement location is between the suction line heat exchanger and the second suction line heat exchanger, wherein the thermal control device is configured to regulate the expansion device so as to regulate the variable volume of refrigerant, so that the refrigerant at the measurement location is in a superheat state.

2. The refrigeration circuit of claim 1, wherein the measurement location is on the suction line heat exchanger.

3. A refrigeration system comprising:

a condenser;

an evaporator;

a thermal control device;

an expansion device that is positioned upstream of the evaporator, the expansion device controlled by the thermal control device to provide a variable volume of refrigerant into the evaporator; and a heat exchanging device having a first portion and a second portion in fluid communication, the first portion and the second portion each configured to have a suction line and a liquid line;

wherein the thermal control device positioned between the first portion and the second portion, the suction line of the first portion is configured to receive refrigerant from the evaporator, the suction line of the second portion is configured to receive refrigerant from the first portion through a connecting suction line, the liquid line of the first portion is configured to receive refrigerant from the second portion through a connecting liquid line, the liquid line of the second portion is configured to receive refrigerant from the condenser, the first portion and the second portion are configured to facilitate heat exchange between the liquid line and the suction line of the first and second portions, the thermal control device is configured to sense a temperature change of refrigerant in the connecting suction line between the first portion and the second portion and regulate the variable volume of the refrigeration in response to the temperature change.

4. The refrigeration system of claim 3, wherein the heat exchanging device is a two-stage suction line heat exchanger, and the first portion and the second portion are a first stage heat exchanging portion and a second stage heat exchanging portion respectively.

5. The refrigeration system of claim 3, wherein the heat exchanging device is a one stage suction line heat exchanger, and the first portion and the second portion are two different portions of the one stage suction line heat exchanger.

6. The refrigeration system of claim 3, wherein the thermal control device is configured to regulate the variable volume of the refrigerant in response to the temperature change in the connecting suction line so that the refrigerant in the connecting suction line is in a superheat vapor state, wherein controlling the volume of the refrigerant includes measuring a temperature of refrigerant flowing between the first suction line heat exchanger and second suction line heat exchanger.

7. A method of controlling an amount of refrigerant entering an evaporator of a refrigeration system during a cooling cycle comprising: directing refrigerant in a liquid/vapor mixture state into an evaporator; directing the refrigerant from the evaporator into a suction line heat exchanger; directing the refrigerant from a condenser into the suction line heat exchanger, wherein the suction line heat exchanger is configured to facilitate heat exchange between the refrigerant flowing out of the evaporation and the refrigerant flowing out of the condenser;

directing the refrigerant from the suction heat exchanger into a second suction line heat exchanger; and controlling a volume of the refrigerant into the evaporator so that the refrigerant flowing out of the suction line heat exchanger is in a superheat vapor state.

8. The method of claim 7, wherein controlling the volume of the refrigerant into the evaporator includes controlling the volume of the refrigerant into the evaporator so that the refrigerant flowing from the evaporator into the suction line heat exchanger is in a liquid/vapor mixture state.

9. The method of claim 8, wherein the liquid/vapor mixture has a set liquid/vapor ratio.

10. The method of claim 7, wherein controlling a volume of the refrigerant into the evaporator includes measuring a temperature of refrigerant flowing out of the suction line heat exchanger, reducing the volume of the refrigerant when the measured temperature is higher than a set temperature, and increasing the volume of the refrigerant when the measured temperature is higher than a set temperature.

11. The method of claim 7, wherein controlling a volume of the refrigerant into the evaporator includes measuring a temperature of refrigerant flowing between the suction line heat exchanger and the second suction line heat exchanger, reducing the volume of the refrigerant when the measured temperature is higher than a set temperature, and increasing the volume of the refrigerant when the measured temperature is higher than a set temperature.

12. The method of claim 7, wherein controlling a volume of the refrigerant into the evaporator includes measuring a temperature of refrigerant on the suction line heat exchanger, reducing the volume of the refrigerant when the measured temperature is higher than a set temperature, and increasing the volume of the refrigerant when the measured temperature is higher than a set temperature.

13. A method of controlling an amount of a refrigerant entering an evaporator of a refrigeration system during a cooling cycle, comprising:

directing the refrigerant into an evaporator;

directing the refrigerant exiting the evaporator into a heat exchanger;

controlling a volume of the refrigerant into the evaporator so that the refrigerant in a middle region of the heat exchanger is at a superheat vapor state and the refrigerant from the evaporator to the heat exchanger is at a liquid/vapor state wherein directing the refrigerant exiting the evaporator in the heat exchanger includes: directing the refrigerant through a first stage suction line of the heat exchanger, and directing the refrigerant exiting the first stage suction line through a second stage suction line of the heat exchanger that is separate from the first stage suction line; and measuring a temperature of the refrigerant at a measurement location between the first stage suction line and the second stage suction line.

14. The method of claim 13, wherein the refrigerant in the liquid/vapor mixture state has a set liquid/vapor ratio.

15. The method of claim 13, wherein controlling a volume of the refrigerant into the evaporator includes measuring a temperature of refrigerant on the suction line heat exchanger, reducing the volume of the refrigerant when the measured temperature is higher than a set temperature, and increasing the volume of the refrigerant when the measured temperature is higher than a set temperature.

16. The method of claim 13, further comprising:

controlling an expansion device located upstream of the evaporator based on the temperature of the refrigerant at the measurement location so that the refrigerant in the middle region of the heat exchanger is at the superheat vapor state and the refrigerant from the evaporator to the heat exchanger is at the liquid/vapor state.

17. The method of claim 13, further comprising:

directing the refrigerant through a condenser;

directing the refrigerant from the condenser through a second stage liquid line of the heat exchanger;

directing the refrigerant from the second stage liquid line of the heat exchanger through a first stage liquid line of the heat exchanger; and directing the refrigerant from the first stage liquid line of the heat exchanger to the evaporator.

* * * * *